United States Patent [19]

Ward

[11] 4,399,624

[45] Aug. 23, 1983

[54] GARMENT PRESSING MACHINE

[75] Inventor: David B. Ward, Madison, N.J.

[73] Assignee: Rheem Textile Systems, Inc., Paterson, N.J.

[21] Appl. No.: 270,359

[22] Filed: Jun. 4, 1981

[51] Int. Cl.[3] ..... D06F 71/06

[52] U.S. Cl. ..... 38/27

[58] Field of Search ..... 38/25, 27

[56] References Cited

U.S. PATENT DOCUMENTS

| | | | |
|---|---|---|---|
| 1,797,720 | 3/1931 | Davis | 38/25 |
| 1,797,757 | 3/1931 | Davis | 38/25 |
| 2,043,469 | 6/1936 | Dewey | 38/25 |

FOREIGN PATENT DOCUMENTS

| | | | |
|---|---|---|---|
| 39-199 | 1/1964 | Japan | 38/27 |
| 1122773 | 8/1968 | United Kingdom | 38/27 |

*Primary Examiner*—Werner H. Schroeder
*Assistant Examiner*—Andrew M. Falik
*Attorney, Agent, or Firm*—Hopgood, Calimafde, Kalil, Blaustein & Judlowe

[57] ABSTRACT

A garment pressing machine wherein a pivotable link is disposed in spaced relationship to the machine arm carrying the machine pressing head and an actuator is arranged between the link and arm to provide the necessary pressure for pressing. Initial pivoting of the arm and link with the actuator therebetween occurs before the application of force by the actuator. A latching mechanism prevents reverse pivoting of the link during force application and the desired pressing pressure is achieved. The latching mechanism is further arranged so as not to latch unless initial pivoting of the arm has been completed.

24 Claims, 3 Drawing Figures

GARMENT PRESSING MACHINE

BACKGROUND OF THE INVENTION

This invention pertains to pressing machines and, in particular, to pressing machines for garments or the like.

Conventional garment pressing machines typically utilize a pivotally mounted lever or arm (y-piece) to move a pressing head into forceful engagement with a pressing surface or support (buck) holding the article to be pressed. In these machines it is customary to first pivot the arm so that the head is closely spaced from or in slight pressure engagement with the buck. Additional force is then applied to the arm so that the head exerts the necessary pressure (e.g., several thousand pounds) on the buck to press the article.

Various pressing machine configurations have been proposed to achieve this pressing action. U.S. Pat. No. 1,797,720 discloses one type machine in which an actuating air cylinder acting through a toggle arrangement provides the initial pivoting of the press arm. The toggle arrangement locks the arm and an expansible fluid filled chamber on the buck is then pressurized to provide the necessary pressing pressure between the head and buck. U.S. Pat. No. 1,797,757 discloses a similar press with an expansible buck, but with a modified arm arrangement. In this case locking of the arm is through engagement of a pawl and ratchet under the pressure created by the expansible buck. An expansible buck type press is also disclosed in U.S. Pat. No. 2,068,643.

In U.S. Pat. No. 3,877,161, on the other hand, the head, rather than the buck, is made expansible and is used to realize the desired pressing pressure.

A further pressing type machine is disclosed in U.S. Pat. No. 4,002,046. In this type machine, a cavity in the buck is selectively pressurized to cause pistons or controlled diaphragm members to urge the buck pressure plate against the pressing head.

Other pressing machine arrangements are also known wherein actuating air cylinders are used to realize both the initial arm pivoting and the desired pressing pressure. In this type of arrangement, a small-bore cylinder provides the initial pivoting under relatively little pressure, while a large-bore cylinder provides pressing action under relatively heavier pressure. Usually, the large-bore cylinder is located such that the cylinder goes over the bottom dead center at some point during the initial pivoting of the arm. In this way, the amount of stroke required of the large-bore cylinder to permit the full motion of the arm is reduced. However, the required stroke is still much longer than that which would be required to provide the slight additional movement of the arm to result in the desired heavy pressure. The large-bore cylinder must, therefore, consume a significant quantity of air which produces no useful result.

The necessity of using a large-bore long-stroke cylinder in the aforesaid pressing machine thus presents disadvantages from both an operational and economic point of view. Furthermore, the other described pressing machines suffer disadvantages of one type or another.

It is a primary object of the present invention to provide a pressing machine of an improved type.

It is a further object of the present invention to provide a pressing machine in which initial pivoting and pressing are realized in an operationally and economically efficient manner.

SUMMARY OF THE INVENTION

In accordance with the principles of the present invention, the above and other objectives are realized in a pressing machine in which the actuator for applying the required pressing pressure to the machine arm is disposed between the arm and a pivotally mounted link extending in spaced relationship to the arm. Initial pivoting of the arm and link with the actuator therebetween occurs before the application of force by the actuator. A latching mechanism prevents reverse pivoting of the link during force application, whereby the desired pressure is achieved. The latching mechanism is further arranged so as not to latch unless initial pivoting of the arm has been completed.

In the embodiment of the invention to be disclosed hereinafter, a further actuating means in the form of a small-bore long-stroke cylinder is used to provided initial pivoting, while the pressing actuator is in the form of a large-bore short-stroke actuator and, in particular, an inflatable rubber actuator.

BRIEF DESCRIPTION OF THE DRAWINGS

The above and other features and aspects of the present invention will become apparent upon reading the following detailed description in conjunction with the accompanying drawings, in which:

FIGS. 2 and 3 show the pressing machine of FIG. 1 after initial pivoting of the machine arm and after application of pressing pressure to the arm.

DETAILED DESCRIPTION OF THE PREFERRED EMBODIMENTS

Figure 1:
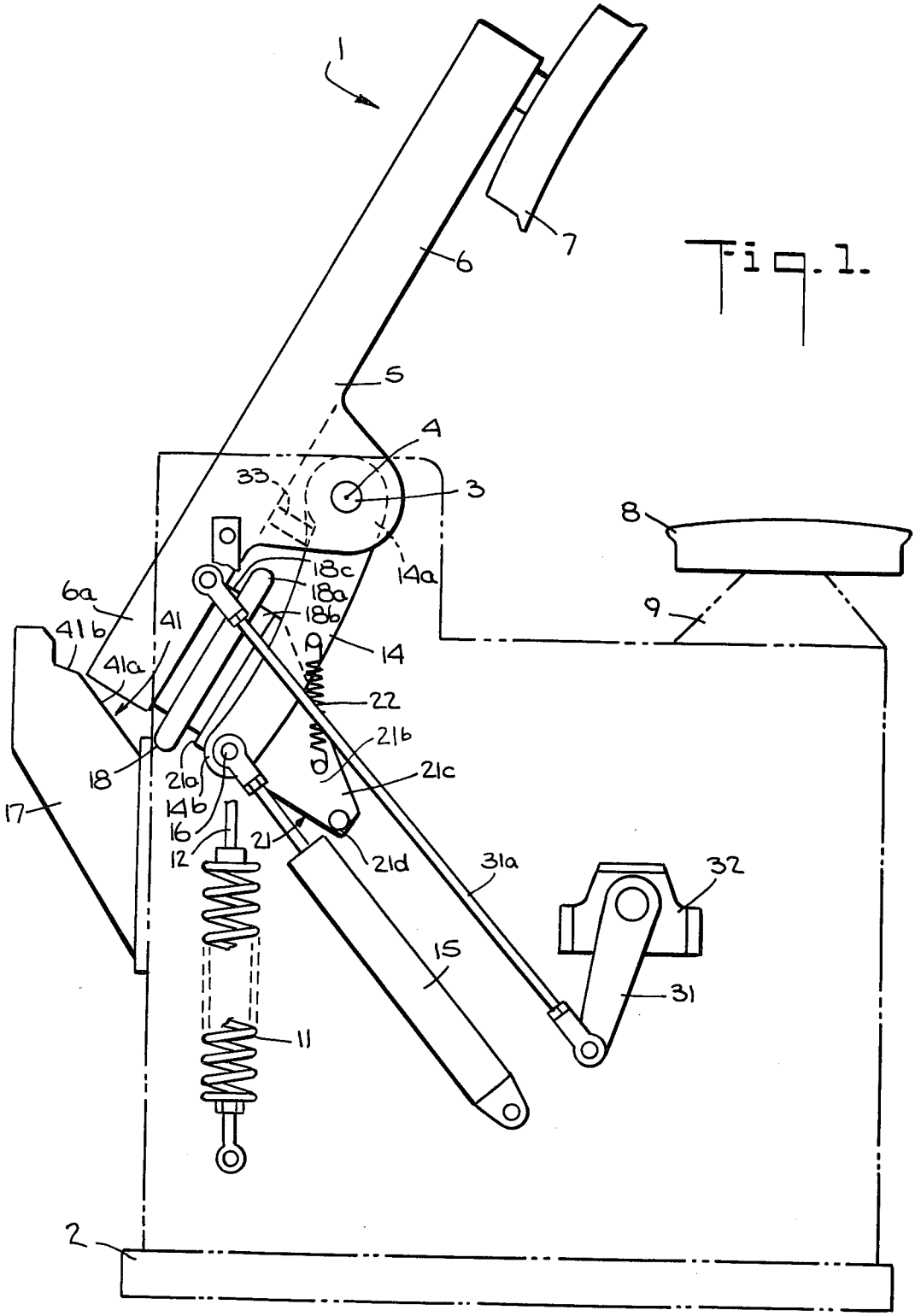
FIG. 1 illustrates schematically, a pressing machine in accordance with the principles of the present invention.

In FIG. 1, the pressing machine 1 comprises a frame 2 carrying a main shaft 3 on which is pivotally mounted arm 5 to pivot about point 4. The arm 5 carries at its forward portion 6, a pressing head 7. Application of force to the rearward portion **6*a* of the arm 5 brings the head 7 into engagement with a complementary pressing surface or buck 8 carrying the article to be pressed. The buck 8 is mounted on the frame 2 via a support 9**.

In the present illustrative case, a counterbalance spring 11 attached to the arm 5 through a link 12 offsets the weight of the head 7 and causes it to remain in the up or fully opened position when no external force is applied to the arm 5. A swiveling control rod assembly 31, **31*a* is also attached to the arm 5 and connects to a shock absorber 32 which smooths out the motion of the arm 5** when opening and closing.

A link 14 pivotally mounted at one end **14*a* on the shaft 3 extends in spaced relationship below the arm portion 6*a*. An actuating means in the form of a small-bore long-stroke air actuating cylinder 15 connects to a secondary shaft 16 affixed to the other end 14*b* of the link 14. The cylinder 15** acts to initially pivot the assembly as will be discussed in more detail below.

Also pivotally mounted on the secondary shaft 16 is a latch 21 whose upper flat surface **21*a* extends forward of the shaft 16 above the link 14 and in the region between the link and the arm portion 6*a*. A biasing spring 22 is connected to face 21*b* of the latch 21 and to the link 14 forward of the shaft 16. The lower end 21*c* of the latch has a roller 21*d* for riding up the steeply inclined portion 41*a* of ramp surface 41 of latching member 17**.

The ramp surface 41 has a lesser inclined portion 41*b* at its upper end for locking the roller movement, as will be discussed hereinafter.

A further actuating means 18 in the form of a large-bore short-stroke actuator is situated above the latch surface 21*a* in the space between the link 14 and the arm portion 6*a*. The actuator 18 includes an air inflatable rubber tube 18*a*, similar to a small automobile tire, held between two supporting blocks 18*b* and 18*c*. These blocks engage the arm portion 6*a* and the latch surface 21*a*, respectively. Positioning of the actuator 18 is such that its center line is forward of the shaft 16, thereby permitting pivoting motion to be applied by the actuator to the latch 21.

A rubber bumper 33 is affixed to the top of the link 14 just rearward of the pivot point 4 and contacts the bottom of the arm 5 whenever the actuator 18 is not actuated. The bumper 33 establishes enough spacing between the arm 5 and link 14 that the tube 18*a* is never allowed to completely collapse, thereby leaving the latch 21 free to pivot slightly about the point 16.

Figure 2:
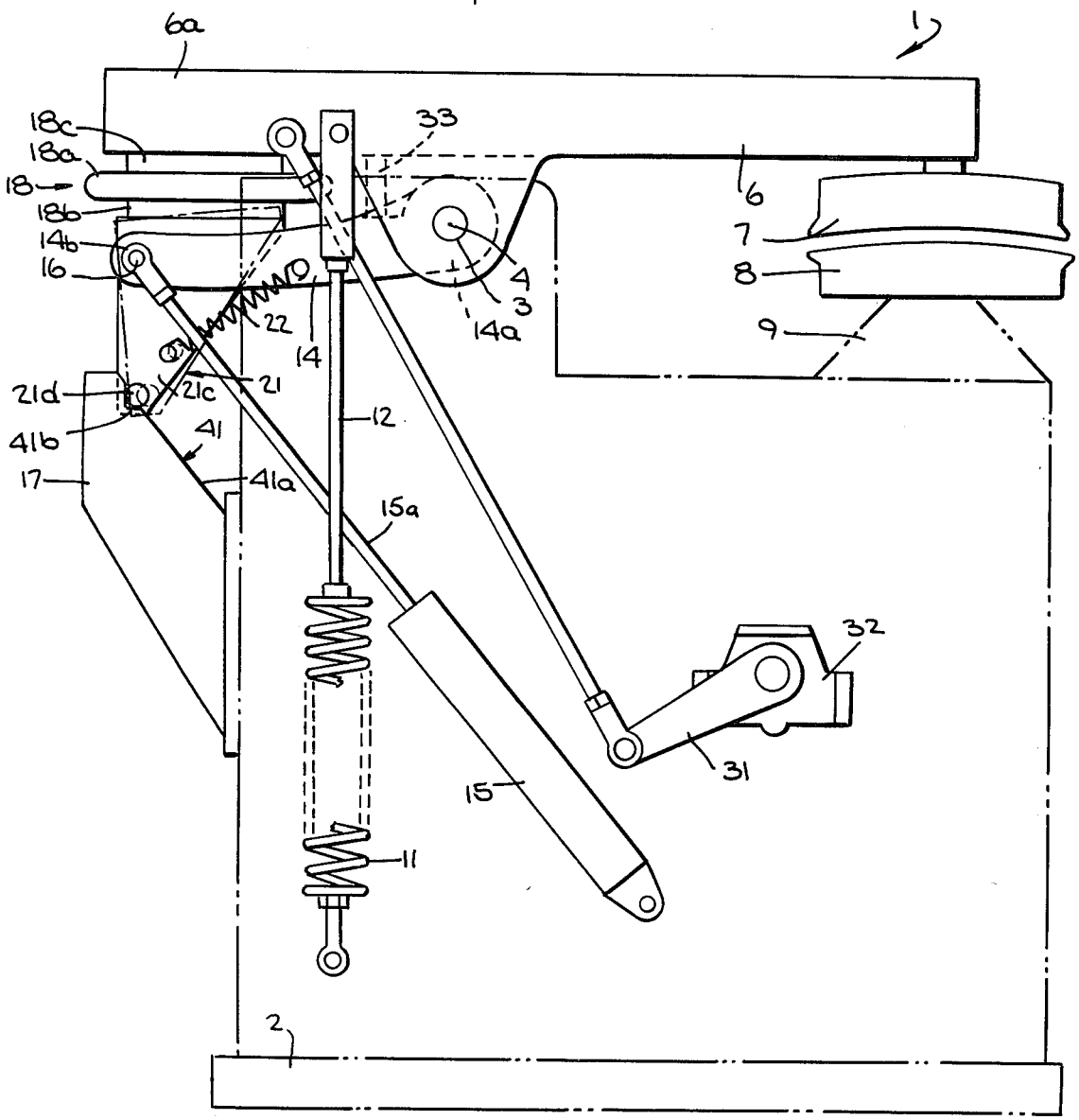
Figure 8:
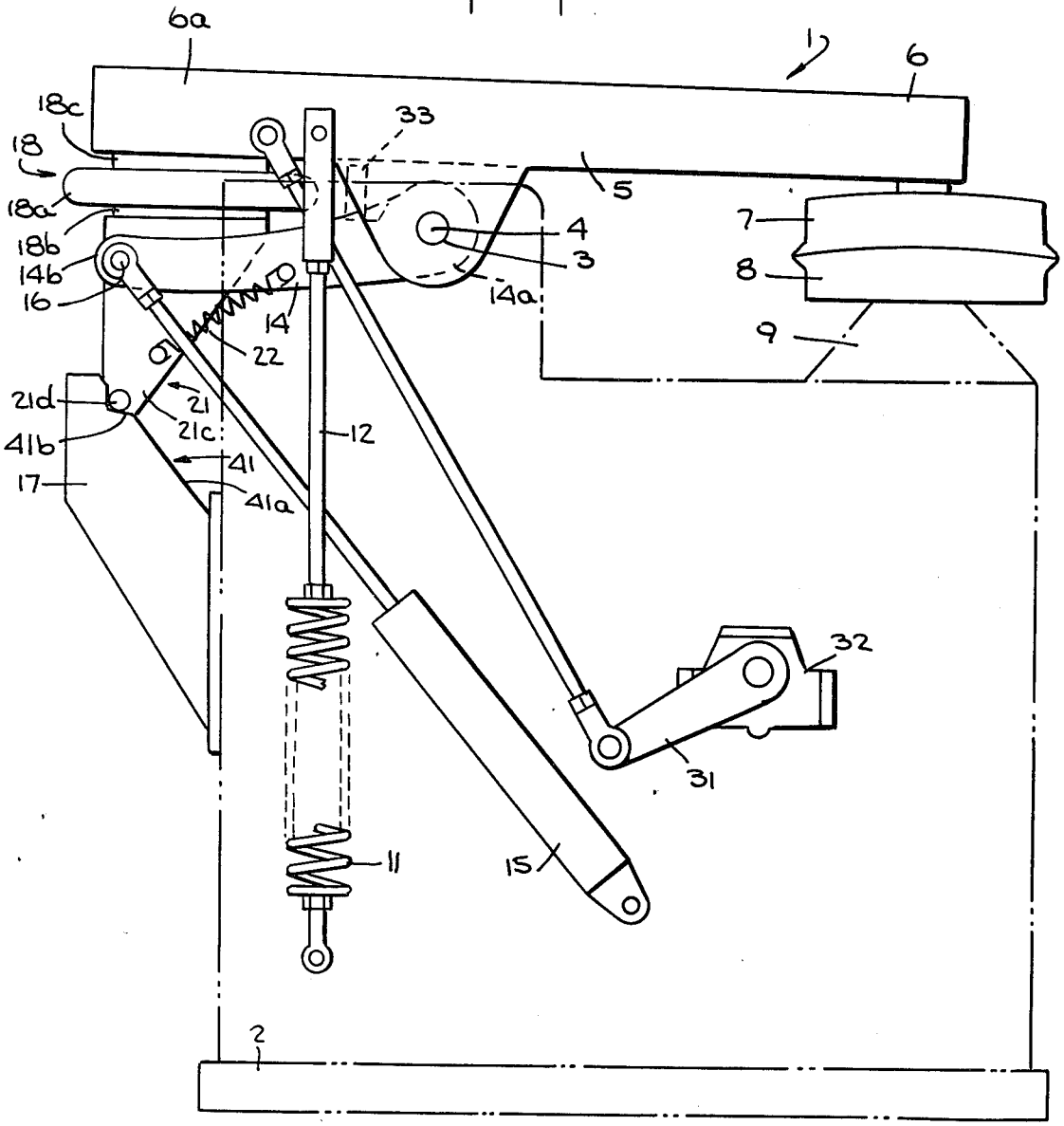

Operation of the pressing machine 1 occurs in two stages. The first stage is depicted in FIG. 2 and results in an initial pivoting of the arm 5 so that the pressing head 7 is brought into adjacent confronting relationship with the buck 8. The second state is shown in FIG. 3 and results in engagement between the head 7 and buck 8 with the pressure or force required to carry out the desired pressing.

More particularly, in the first operating stage, air actuating cylinder 15 is operated and the cylinder rod 15*a* provides a pivoting force to the link 14 through the shaft 16. This force is also applied through the bumper 33 to the arm portion 6*a*. The arm 5 and link 14 are thereby pivoted to a predetermined or preselected position.

Operation of actuating cylinder is such that the pivoting force is sufficient to overcome the tension of spring 11 and the stroke of the cylinder is adjusted so that a position is reached which brings the head 7 closely adjacent, but spaced from the buck 8. Alternatively, the cylinder stroke could have been adjusted so that the head 7 engaged buck 8 under slight pressure. In any case, pivoting of the arm and link also brings the roller 21*d* up the portion 41*a* of the ramp surface 41 to a position shown in phantom lines on a level with or slightly above the lesser angled portion 41*b*. The latch 21 thus is in adjacent but unlatched position relative to the latch member 17. It should be noted that the latter member 17 could be made to be adjustable so as to permit downward or upward movement of the member. Such adjustable feature would enable adjustment of the latch member to account for changes in the thickness of the resilient padding of the buck as well as for changes in the amount of spacing between the buck and head upon initial pivoting.

Upon completion of this initial pivoting, the second stage of operation is carried out by pressurization of air actuator 18*a* causing a force to be exerted between the blocks 18*b* and 18*c*. This force, in turn, is transmitted to the arm portion 6*a*, as well as to the latch 21 and the link 14. The latch 21, due to the positioning of the actuator 18, is thereby caused to pivot bringing the roller 21*d* into engagement with the surface portion 41*b* of latch member 17, as shown in solid lines in FIG. 2 and in FIG. 3. Engagement of the roller 21*d* and surface portion 41*b* is sufficient to prevent movement of the roller 21*d* down such surface. Further pivoting of the latch 21 and reverse or counter pivoting of the link 14 thus does not occur. These two elements, the latch 21 and link 14, are therefore locked to the frame 2. As a result, the actuator force (this force might, for example, be approximately one ton), acts primarily upwardly against the arm portion 6*a*. This causes further pivoting of the arm 5 to bring the head 7 into engagement with the buck 8 with sufficient pressure to press the article.

When the air pressure to actuator 18 is terminated, the force exerted by the actuator ceases. The head and buck disengage and the roller 21*d* is now able to slide down the surface portions 41*b* and 41*a*. Further release by actuator 15, causes the entire assembly to reverse or counter pivot under the action of spring 11 bringing the assembly to its original starting position.

As can be appreciated, the present pressing machine has the attendant advantages of permitting the use of large-bore short-stroke and small-bore long-stroke actuators for effecting pressing engagement and initial pivoting, respectively, of the pressing assembly. As a result, air consumption is reduced to a minimum and the speed of operation is improved because there is virtually no non-essential chamber volume to fill.

Furthermore, pressing pressure cannot be exerted unless the assembly has completed its initial pivoting to place the arm and link at their preselected positions. Thus, for example, if the actuator 18 is pressurized before the initial pivoting occurs, then the link 14 and arm 5 will be spread apart before the roller 21*d* and surface portion 41*b* are positioned to engage. As a result, no engagement will occur between head 7 and buck 8 and the actuator 18 cannot cause exertion of pressing pressure between the buck and head. Similarly, if an obstruction, such as, for example, an operator's hand, is on the buck preventing completion of the initial pivoting, then the roller 21*d* will not be able to be moved into engagement with the surface portion 41*b*. As a result, pressurization of actuator 18 will result in movement of the roller down the surface portion 41*a* and reverse rotation of link 14. No pressing pressure will therefore be exacted between the buck and head.

In all cases, it is understood that the above-described arrangements are merely illustrative of the many possible specific embodiments which represent applications of the present invention. Numerous and varied other arrangements can readily be devised in accordance with the principles of the present invention without departing from the spirit and scope of the invention.

What is claimed is:

1. A pressing machine comprising: a frame; a buck supported on said frame, an arm pivotally mounted at a point on said frame with first and second arm portions forward and rearward of said pivot point, respectively; a pressing head affixed to said first arm portion; a link pivotally mounted on said frame and extending in spaced relationship to said second arm portion; an actuator means disposed between said second arm portion and said link for selectively applying an actuating force between said second arm portion and said link tending to rotate said arm relative to said link to urge said head forcefully toward said buck.

2. A pressing machine in accordance with claim 1 wherein said arm and link with said actuator means operatively coupled therebetween are pivotable in a first direction to a predetermined position in which said head is in confronting relation to said buck; and said machine further includes a latching means engageable when said arm and link are in said predetermined position for inhibiting reverse direction pivoting of said link when said actuating force is applied between said link and arm portion with said link in said predetermined position.

3. A pressing machine in accordance with claim 2 wherein said actuator means is of relatively large-bore and of relatively short-stroke.

4. A pressing machine in accordance with claim 3 wherein said actuator means comprises an inflatable rubber actuator.

5. A pressing machine in accordance with claim 2, further comprising:

further actuator means for selectively applying an actuating force to said link.

6. A pressing machine in accordance with claim 5 wherein said further actuator means is mounted between said frame and link for imparting movement to said link relative to said frame and includes a relatively small-bore relatively large-stroke actuator.

7. A pressing machine in accordance with claim 6 wherein said relatively small-bore relatively large-stroke actuator is an air cylinder actuator.

8. A pressing machine in accordance in claim 2 wherein said arm and said link have a common pivot.

9. A pressing machine in accordance with claim 2 wherein said latching means is incapable of inhibiting said reverse direction pivoting of said link if said actuating force is applied prior to said link reaching said predetermined position.

10. A pressing machine in accordance with claim 2 wherein said latching means is responsive to said actuator means.

11. A pressing machine in accordance with claim 10 wherein said latching means is movably attached to said link and is moved by said actuating force into latching engagement position.

12. A pressing machine in accordance with claim 10 wherein said latching means includes: a first latching member pivotally attached to said link and having a latching structure; and a second latching member affixed to said frame, said second latching member having a latching surface, said latching structure being movable into adjacent non-engaged relationship with said latching surface upon pivoting said arm and link to said predetermined position and becoming latchingly engaged with said latching surface upon pivoting of said latching member by said actuating force when said link is in said predetermined position.

13. A pressing machine in accordance with claim 12 wherein said actuator means is supported between an upper surface of said first latching member and an opposing surface of said second arm portion.

14. A pressing machine in accordance with claim 13 wherein said actuator means includes an inflatable rubber actuator.

15. A pressing machine in accordance with claim 13 further comprising: first means for biasing said first latching member toward a non-latching position.

16. A pressing machine in accordance with claim 15 wherein said first biasing means is mounted between said first latching member and said link.

17. A pressing machine in accordance with claim 16 further comprising:

second biasing means for biasing said arm out of said predetermined position.

18. A pressing machine in accordance with claim 17 wherein said second biasing means is mounted between said second arm portion and said frame.

19. A pressing machine in accordance with claim 18 further comprising: further actuator means for applying an actuating force opposing said second biasing means for pivoting said arm and link to said predetermined position.

20. A pressing machine in accordance with claim 19 wherein said further actuator means is mounted between said link and said frame operatively coupled thereto.

21. A pressing machine in accordance with claim 12 wherein said latching structure includes a roller, said second latching member latching surface includes a first inclined portion and a second lesser inclined portion, said roller rolling along said first inclined portion and into said non-engaged relationship with said second inclined portion upon pivoting said arm and link to said predetermined position, and said roller becoming latchingly engaged with said second inclined portion upon pivoting of said first latching member by said actuating force when said link is in said predetermined position.

22. A pressing machine comprising in combination: a frame; a buck supported on said frame; an arm pivotally mounted on said frame with a pressing head at one end for movement into and out of pressing engagement with said buck; a link pivotally mounted on said frame on a common pivot with said arm; a first actuator coupled to both said link and said frame for imparting rotation to said link about said pivot relative to said frame; means interposed between said link and said arm for engagement with both to communicate rotation from said link to said arm in only the head-to-buck closing direction; and a second actuator carried by said link and coupled to said arm for operation only when said head is proximate to said buck for urging said arm relative to both said frame and said link for applying pressing force to said head against said buck.

23. A pressing machine in accordance with claim 22 wherein a pivotal latching member is carried at the free end of said link joining said second actuator to said link, and a latch engaging member is carried by said frame for engagement by said latching member when said arm positions said head proximate to said buck and actuating force is thereafter developed by said second actuator.

24. A pressing machine comprising in combination: a frame; a buck supported on said frame; an arm pivotally mounted on said frame with a pressing head at one end for movement into and out of pressing engagement with said buck; a first actuator; means coupling said first actuator to said arm for selectively pivoting said arm relative to said frame for moving said head toward and away from said buck; a second actuator carried by said arm and movable therewith relative to said frame during a first mode of operation; and latching means operatively coupled to said second actuator and said frame for latching said second actuator to said frame during a second mode of operation when said arm has positioned said head proximate to said buck, said second mode of operation being initiated by activation of said second actuator when said head is proximate to said buck and thereby imparting further pivoting to said arm relative to said frame to apply pressing force to said head relative to said buck.

* * * * *